United States Patent [19]

Childers

[11] 4,406,812

[45] Sep. 27, 1983

[54] DEODORANT AND RECONDITIONER FOR METAL WORKING FLUIDS

[75] Inventor: Jean C. Childers, Charlotte, N.C.

[73] Assignee: Chemed Corporation, Cincinnati, Ohio

[21] Appl. No.: 212,768

[22] Filed: Dec. 4, 1980

[51] Int. Cl.[3] ..... C01B 13/00; C01B 15/00

[52] U.S. Cl. ..... 252/186.21; 252/49.3; 252/99; 252/186.1; 252/186.28; 252/186.29; 252/186.3; 252/186.31; 252/192

[58] Field of Search ..... 252/186, 25, 99, 192, 252/186.1, 186.21, 186.28, 186.31, 186.29, 186.3, 49.3

[56] References Cited

U.S. PATENT DOCUMENTS 4,055,655 10/1977 Maurer et al. ..... 424/295
4,128,491 12/1978 Melles ..... 252/186
4,129,509 12/1978 Shringarpurey et al. ..... 252/36
4,156,039 5/1979 Klebe et al. ..... 252/186
4,171,280 10/1979 Maddox et al. ..... 252/186
4,194,025 3/1980 Klebe et al. ..... 252/186
4,247,537 1/1981 Lunn et al. ..... 252/186

*Primary Examiner*—Allan Lieberman
*Attorney, Agent, or Firm*—Wood, Herron & Evans

[57] ABSTRACT

A composition for deodorizing and rejuvenating used metal working fluids comprising a compound which releases active oxygen, a compound which acts as an alkaline buffering agent and compound which provides an extreme pressure additive. Combinations of sodium perborate and sodium percarbonate are preferred. Additional sequestrants, buffering agents and extenders can also be employed.

5 Claims, No Drawings

DEODORANT AND RECONDITIONER FOR METAL WORKING FLUIDS

BACKGROUND OF THE INVENTION

1. Field of the Invention

This invention relates to a composition which can be added to used metal working fluids to remove obnoxious sulfurous odors as well as to recondition the fluid.

2. Description of the Prior Art

Metal working fluids usually contain an emulsifier which is commonly of a sulfonate type as well as containing sulfur impurities in the oil-base portion of the fluid. These materials act as nutrients for anaerobic microorganisms which thereby generate obnoxious odors. Since these microorganisms deplete the emulsifier in the fluid, the oil phase of the emulsion splits off resulting in an increased tramp oil level in the sump.

Biocides are commonly incorporated in metal working fluid formulations to control the growth of these microorganisms, but the biocides become depleted as the bath ages and the effect of the biocide declines so the microorganisms can eventually take over. These problems are particularly severe with soluble oil emulsion type metal working fluids, but they can also occur with synthetic types of fluids.

Attempts have been made to solve this problem. In U.S. Pat. No. 4,129,509 there is disclosed a sodium copper (II) citrate which is used as deodorizer and emulsion stabilizer for the soluble oil metal working fluids. In U.S. Pat. No. 4,055,655 this same material is used as a biocide. In both of these products the active ingredient provides a slow release of the copper ions which precipitate the hydrogen sulfide produced. Use of this material is restricted to soluble oil type fluids since these materials do not work with synthetic fluids.

3. Objects of the Invention

It is an object of this invention to formulate a powder composition which can be added to used metal working fluids to remove the obnoxious sulfurous odors that occur during plant shutdowns or when lower pH anaerobic conditions exist in the fluid as well as to recondition the used working fluid.

It is a further object of this invention to obtain a composition which eliminates rancid odors from the used metal working fluid and, when added in excess of that need to satisfy the demand of the existing malodors, will prevent their return.

It is a further object of this invention to obtain a composition which restores the milky white color to a used metal working fluid.

It is a further object of this invention to obtain a composition which increases the alkaline buffering capacity of a used metal working fluid and thus to reduce the rusting and/or corrosion of finished metal goods.

It is a further object of this invention to obtain a composition which increases the lubricity of a used metal working fluid.

It is another object of this invention to obtain a composition which when applied to a used metal working fluid lowers the microorganism count.

It is still another object of this invention to provide a composition which stabilizes the emulsion in a used metal working fluid to reduce the tramp oil content in the sump of the working fluid system.

It is still another object of this invention to provide a method whereby a used metal working fluid stays aerobic and its useful life is extended as well as improving the tool life and the appearance of the finished goods by adding a deodorant and a rejuvenate composition to the used metal working fluid.

These and further objects will become apparent as the description of the invention proceeds.

SUMMARY OF THE INVENTION

A composition has been obtained which with a single application to a used metal working fluid will eliminate the rancid odors and will decolorize the dark color of the used fluid. With periodic reapplication it will prevent the reoccurrence of these problems and prolong the useful life of the fluid. The composition contains components which release active oxygen, serve as a buffering agent and provide an extreme pressure additive to enhance the lubricity of the fluid.

The composition contains at least one compound which releases active oxygen so as to convert the sulfurous odor compounds to free sulfates or harmless elemental sulfur. The compound also acts as a biocide while oxidizing insoluble metal sulfides to the soluble form. Compounds which release active oxygen in situ are hydrogen peroxide or its addition compound with alkaline metal carbonates, borates, pyrophosphates or their hydrates and the like. Other compounds include the addition of hydrogen peroxide with urea or any combination of mixtures of these compounds. Preferred compounds for this function include a combination of sodium perborate with sodium percarbonate.

A second component of the composition is an alkaline buffering agent. When using the combination of two preferred ingredients listed above, these ingredients also serve this function since they are both alkaline in nature. In another preferred embodiment it is desirable to supplement these compounds with a water soluble alkaline inorganic or organic buffering agent. Tetrasodium pyrophosphate (TSPP) is an effective inorganic salt while sodium acetate is a useful organic salt.

The third component of the composition is a compound which provides an extreme pressure additive to enhance the lubricity of the fluid. When using the perborate compound as one of the preferred compounds for the active oxygen source, it simultaneously provides borates ions which have excellent extreme pressure characteristics. Other water soluble or water dispersible extreme pressure additives may be employed.

The composition of this invention has components which provide the three properties listed above. In a preferred embodiment it is possible to use a perborate salt alone or in combination with a percarbonate to provide all three functions so as to obtain the objective of this invention. In addition other optional agents can also be added. One of these is a sequestrant which is capable of chelating metal cations such as calcium and magnesium which in their unchelated form tend to destabilize the metal working emulsion. Preferred sequestrants are water soluble organic chelates such as EDTA, NTA or their alkali metal salts. Another optional agent is a water soluble extender such as sodium sulfate which increases the life of the composition which serves as a bulking agent to improve the accuracy of metering the composition when applied to the used metal working fluid.

DESCRIPTION OF THE PREFERRED EMBODIMENTS

One of the key components of the present composition is at least one compound which releases active oxygen. This component restores and, by periodic reapplication, maintains the desirable aerobic condition in the fluid. When used in excess, reoccurrence of the malodorous condition is delayed. The presence of active oxygen eliminates sulfurous odors by oxidizing them to water soluble, odor free sulfates or even to harmless elemental sulfur. The biocidal properties of active oxygen also serves to control microorganisms counts and thus prevent the deterioration of the emulsifier in the fluid. A further function of the active oxygen releasing compound is to oxidize the insoluble color-forming metal sulfides, such as iron sulfide, which cause the fluid to progressively darken with use. By oxidizing these sulfides they are converted to lighter colored soluble sulfates such as $Fe_2(SO_4)_3$. Exemplary of such active oxygen sources are hydrogen peroxide, or its addition compounds with alkali metal carbonates, borates, pyrophosphonates or their hydrates, and the like, or with urea, or mixtures thereof. These hydrogen peroxide addition compounds are also known as peroxyhydrates, superoxides and peroxygen compounds such as peroxyborates. The preferred compound is sodium perborate or a combination of sodium perborate with sodium percarbonate. Sodium percarbonate is also known as sodium carbonate peroxide. In selecting other oxidizing compounds care must be taken that they are not too explosive. For example, sodium perchlorate, sodium periodate and sodium permangemate may present a flammability risk because of their high oxygen content. Sodium persulfate is also a possible oxidizing agent, but it releases the sulfate which is a feed material for the sulfate reducing microorganisms. Thus, sodium persulfate may not be an optimum oxidizing agent.

The alkaline buffering agent serves to enhance the reserve alkalinity of the fluid and to keep the fluid at a desirable pH in the range of 7.5–9.5. By preventing the system from going to the acid range, one minimizes the sulfurous odor emission as well as the rusting and corrosion of the equipment and finished goods that come in contact with the metal working fluid. The alkali metal salts of the preferred hydrogen peroxide addition compounds sodium perborate and sodium percarbonate are alkaline in nature, and so act as alkaline buffer agents as well as acting as active oxygen sources. They may be supplemented by water soluble alkaline inorganic or organic salts which have known alkaline buffering activity. Complex phosphorates are preferred and include inorganic salts, tetrasodium pyrophosphate (TSPP) and sodium tripolyphosphates. However, other commonly known inorganic salts can also be used. Sodium acetate is representative of a useful organic salt.

The extreme pressure additive is chosen for inclusion into the composition of this invention to enhance the lubricity of the fluid and to thereby extend the tooling life. The use of the perborate compound as the active oxygen source simultaneously provides borate ions which have excellent extreme pressure characteristics. Other useful water soluble or water dispersible extreme pressure additives may be employed, such as organic phosphate esters, chlorinated or sulfurized oils, or the like. A further advantage of selecting the perborate compound is that the borate ion also acts as a rust inhibitor.

Other optional agents can be added to the basic composition. For example, a sequestrant can be added which is capable of chelating metal cations such as calcium and magnesium. These are the ions which may have entered the fluid from make up hard water. Sequestrants for other cations can also be added such as cations derived from metal fines which enter the metal working fluid from the work piece as a result of machining or grinding operations. If these metallic and/or cationic impurities are not removed, they can cause emulsion instability and they can shorten the useful life of the fluid as well as contribute to the build up of the tramp oil. Any water soluble organic chelant such as EDTA, NTA, etc. or inorganic chelants like pyrophosphates or other condensed polyphosphates are useful for this purpose.

Another optional ingredient is a water soluble extender such as sodium sulfate. In some instances where there is sulfate reducing bacteria present, then other non sulfate containing extenders may be selected such as sodium carbonate, sodium bicarbonate and sodium nitrate. An extender is also helpful in metering accurately out the amount of the complete composition to be added to the used metal working fluid. For example, if on normally used 1 pound of the composition for 50 gallons of used fluid, then if one wanted to use the same convenient 1 pound quantity for a 25 gallon tank, one could take ½ pound of the composition and add ½ pound of extender to obtain a new mixture that could be added in a convenient 1 pound amount.

The term metal working fluid as used herein applies to those fluids which function to lubricate, cool, clean and inhibit decomposition of metal surfaces during the process of metal working. These fluids are well known to those who practice the art of metal working. There are two basic areas of metal working, i.e., mechanical operations, referring to cutting, drilling, reaming, turning, milling, broaching, rolling, drawing, and the like; and non-mechanical operations referring to washing, quenching after heat-treating, and the like. It would be generally accepted that metal working compositions in mechanical operations provide lubricity, cooling, cleaning and rust inhibiting functions, whereas in non-mechanical operations they primarily provide cleaning, rust inhibiting and cooling functions.

The following compositions are considered to be effective:

| | Acceptable Range | Preferred Range |
|---|---|---|
| Peroxygen compound(s) | 2–99% | 30–99% |
| A mixture of the following is particularly effective: | | |
| Sodium perborate | 1–99% | 10–99% |
| Sodium percarbonate | 1–99% | 10–99% |
| Buffering Agent | 0–10% | 0–5% |
| Tetrasodium pyrophosphate | | |
| Sequestrant | 0–10% | 0–5% |
| Trisodium EDTA trihydrate | | |
| Extender | 0–98% | 0–70% |
| Sodium sulfate | | |

Using dilutions of the additive should provide enough active oxygen to react with the sulfurous odor causing impurities in the fluid and leave a residual so that the bath is aerobic in nature.

The normal level of use of the additive is about 1 pound per 50 gallons of the metal working fluid. It has been surprisingly found that there is a wide margin of use since the amount of the composition added can be exceeded ten fold without exceeding the solubility of the additive or its usefulness. However, reasonable care should be taken not to severely over-use the additive or the alkaline buffering agents which can raise the pH level of the fluid since the pH of the solution should be maintained between about 7.5 to about 9.5 to safely protect the metals.

Having described the basic aspects of the invention, the following examples are given to illustrate specific embodiments thereof.

EXAMPLE 1

This examples illustrates the ability of the present composition to provide substantial reduction in the total count of organisms per milliliter where there are bacteria, molds and yeasts present.

A composition according to the present invention was formulated comprising 50% by weight sodium percarbonate, 45% by weight sodium perborate, 3% by weight trisodium ethylenediamine tetraacetate and 2% by weight tetrasodium pyrophosphate.

The cutting fluid used was ICF-33 manufactured by DuBois Chemicals and used at a concentration of 1 part ICF-33 to 20 parts of water. This used cutting fluid contained a mixed population of bacteria, yeasts and molds. No sulfate reducing bacteria were present. As seen in Table 1 below, the microbial number population was determined over a period of 7 days. The control had no material added while in the remaining runs sufficient compound was added to provide an active oxygen level of from 0.05% to 1% $H_2O_2$.

TABLE 1

| | | INITIAL NUMBERS | CONTACT TIME 2 HOURS | 6 HOURS | 24 HOURS | 48 HOURS | 7 DAYS |
|---|---|---|---|---|---|---|---|
| Growth Control | TC* | 26,000,000 | 18,500,000 | 23,300,000 | 24,900,000 | 24,100,000 | 12,400,000 |
| | Y/M | 88,000 | 60,000 | 67,000 | 67,000 | 69,000 | 80,000 |
| 1% $H_2O_2$ | TC | 30,200,000 | 3,250 | 740 | 10 | <10 | 530 |
| | Y/M | 57,000 | 1,400 | 260 | <10 | <10 | <10 |
| 0.5% $H_2O_2$ | TC | 20,100,000 | 4,030 | 2,380 | 300 | 100 | 380 |
| | Y/M | 32,000 | 2,460 | 980 | 300 | 50 | <10 |
| 0.2% $H_2O_2$ | TC | 10,400,000 | 6,330 | 28,000 | 4,030 | 420 | 1,030 |
| | Y/M | 32,000 | 8,630 | 6,140 | 1,000 | 390 | <10 |
| 0.1% $H_2O_2$ | TC | 23,600,000 | 234,000 | 481,000 | 403,000 | 1,600,000 | 22,000,000 NR |
| | Y/M | 36,000 | 12,080 | 6,000 | >3,000 | 1,620 | 730,000 |
| 0.05% $H_2O_2$ | TC | 26,500,000 | 2,600,000 | 4,500,000 | 16,600,000 | 11,600,000 | 27,900,000 NR |
| | Y/M | 51,000 | 19,260 | 6,000 | >3,000 | 4,600 | 43,000 |

*TC = Total Count (organisms/ml)
Y/M = Yeast and Mold Count (organisms/ml)
NR = No reduction The composition providing the equivalent of 0.2% $H_2O_2$ appears to be an effective, excellent antimicrobial against bacteria, yeasts and molds for a period of up to one week. When the additive is employed at a level equivalent to 0.1% $H_2O_2$ it is not as effective as an antimicrobial.

EXAMPLE 2

This example illustrates the ability of the present composition to provide a substantial reduction in the total count of organisms per milliliter when there are no molds or yeast present, but when there are bacteria and sulfate reducing microorganisms which are sulfurous odor producers.

Again, the same composition described in Example 1 was used. The cutting fluid used was pooled field samples of used ICF-23E. ICF-23E is sold by DuBois Chemicals. As indicated above this liquid has no molds or yeast present, but it was contaminated with a mixture of bacteria and sulfate reducing microorganisms which are sulfurous odor producers. The same test procedure in Example 1 was followed and the results are set forth in Table 2.

TABLE 2

| | INITIAL NUMBERS | CONTACT TIME 2 HOURS | 6 HOURS | 24 HOURS | 48 HOURS | 7 DAYS |
|---|---|---|---|---|---|---|
| Growth Control | 6,100,000 | 5,100,000 | 6,400,000 | 26,100,000 | 52,000,000 | 26,100,000 |
| 1.5% $H_2O_2$ | 6,100,000 | 780 | 600 | 4,620 | 8,000 | 710 |
| 1.0% $H_2O_2$ | 6,100,000 | 740 | 4,650 | 220,000 | 2,000 | 710 |
| 0.5% $H_2O_2$ | 6,100,000 | 15,000 | 1,390 | 2,000,000 | 620,000 | 630 |
| 0.2% $H_2O_2$ | 6,100,000 | 1,300,000 | 68,000 | 4,300,000 | 2,100,000 | 680 |
| 0.1% $H_2O_2$ | 6,100,000 | 2,400,000 | 3,300,000 | 6,600,000 | 5,000,000 | 10,800,000 |
| 0.05% $H_2O_2$ | 6,100,000 | 3,900,000 | 5,700,000 | 15,200,000 | 17,400,000 | 56,000,000 |

For this used sample, the composition exhibited excellent microbial control at an equivalent of 0.2% $H_2O_2$ throughout the one week test. At this equivalent level of 0.2% $H_2O_2$ level the composition is capable of eliminating the sulfate reducing bacterial population that is a sulfurous odor producer. At an equivalent level of 0.1% $H_2O_2$ the additive was not as effective after 24 hours into the test.

EXAMPLE 3

This example illustrates the enhancement of lubricity of the metal working fluid due to the use of the composition of this invention.

Using a Falex Lubricant Tester manufactured by the Faville-LeValley Corp. of Bellwood Illinois and a fresh soluble oil fluid, the pressure applied at failure was 3,100 pounds and the appearance of the pressure pin was smooth and acceptable.

When testing a used sample of the same product the pressure applied at failure was only 2,600 pounds and the appearance of the pressure pin showed appreciable scarring and welding and was thus unacceptable.

This same used fluid was then treated with the composition of the present invention as described in Example 1 at a level of 1 pound per 50 gallons of working fluid. The pressure applied at failure was a very high value of 3,500 and the pressure pin had a mirror like appearance which was excellent.

Thus, the additive was able to rejuvenate the used metal working fluid which had deteriorated until it was no longer providing acceptable results. The performance of the treated product exceeded that of a fresh, unused fluid.

What is claimed:

1. The method of deodorizing and rejuvenating a used metal working fluid comprising, adding to said fluid an effective amount of a composition comprising, in approximate percent by weight of the composition:

2–99% of at least one oxygen-releasing compound of the class consisting of hydrogen peroxide; addition compounds of hydrogen peroxide with alkaline metal compounds which are carbonates, borates, or pyrophosphates; the hydrates of such addition compounds; and addition compounds of hydrogen peroxide and urea;

0–10% water soluble alkaline buffering agent; and

0–10% water soluble chelant, and maintaining the pH of the fluid in the range of approximately 7.5–9.5.

2. The method of claim 1 wherein the oxygen-releasing compound is selected from the group consisting of sodium perborate, sodium percarbonate, and mixtures thereof.

3. The method of claim 1 wherein the buffering agent is tetrasodium pyrosphate.

4. The method of claim 1 wherein the chelant is trisodium ethylenediamine tetraacetate.

5. The method of claim 1 wherein the composition comprises,

10–99% sodium percarbonate

10–99% sodium perborate

0–5% buffering agent

0–5% chelant.

* * * * *